US005265287A

United States Patent [19]

Henkin et al.

[11] Patent Number: 5,265,287

[45] Date of Patent: Nov. 30, 1993

[54] TAP WATER POWERED SHOWER WATER RECIRCULATION SYSTEM

[76] Inventors: Melvyn L. Henkin, 5011 Donna Ave., Tarzana, Calif. 91356; Jordan M. Laby, 3038 Bayshore, Ventura, Calif. 93001

[21] Appl. No.: 754,606

[22] Filed: Sep. 4, 1991

[51] Int. Cl.[5] ..... A47K 3/22

[52] U.S. Cl. ..... 4/605; 4/596

[58] Field of Search ..... 4/546, 559, 665, 597, 4/602, 603, 605; 210/416.2, 790; 239/124, 310, 318

[56] References Cited

U.S. PATENT DOCUMENTS

| | | | |
|---|---|---|---|
| 1,065,265 | 6/1913 | Nordmark | 4/603 X |
| 3,646,618 | 3/1972 | Johnson | 4/599 |
| 3,860,977 | 1/1975 | Politz | 4/682 |
| 4,099,272 | 7/1978 | Sowder | 4/555 |
| 4,194,252 | 3/1980 | Tsuei | 4/694 |
| 4,224,700 | 9/1980 | Bloys | 4/603 |
| 4,413,363 | 11/1983 | Troiano | 4/599 |
| 4,828,709 | 5/1989 | Houser et al. | 4/DIG. 9 |
| 4,893,364 | 1/1990 | Keeler | 4/602 X |
| 4,975,992 | 12/1990 | Patterson et al. | 4/599 |

FOREIGN PATENT DOCUMENTS

| | | | |
|---|---|---|---|
| 0070256 | 7/1892 | Fed. Rep. of Germany | 4/603 |
| 0521695 | 5/1940 | United Kingdom | 4/603 |

*Primary Examiner*—William A. Cuchlinski, Jr.
*Assistant Examiner*—W. Morris Worth
*Attorney, Agent, or Firm*—Freilich, Hornbaker & Rosen

[57] ABSTRACT

A water recirculation system which derives energy from an available pressurized tap water supply to filter and return previously discharged water to a water discharge device. A system embodiment for use in a new shower stall or shower/bathtub installation includes a shower head and recirculation means including a tap water powered pump for returning water discharged from the shower head via a return tube mounted behind the wall to the pump for mixing with supplied tap water for delivery to the shower head inlet.

21 Claims, 7 Drawing Sheets

10
11

TAP WATER POWERED SHOWER WATER RECIRCULATION SYSTEM

FIELD OF THE INVENTION

This invention relates to shower water plumbing systems incorporating tap water powered means for recirculating discharged shower water.

BACKGROUND OF THE INVENTION

Water shortages frequently occur in many parts of the United States and the rest of the world. As a consequence, considerable effort has been expended to develop low water utilization devices such as low flow shower heads, toilets, etc. Many municipalities in California, for example encourage or mandate the use of toilets which use less than 2.0 gallons per flush and shower heads which discharge less than 3.0 gallons per minute. Various such devices are widely commercially available and are described in the literature. In general, although such devices perform adequately, they usually do not function as well as conventional full flow devices. For example, whereas conventional full flow shower heads typically discharge 3.0 to 8.0 gallons per minute, low flow shower heads which discharge less than 3.0 gallons per minute, are often perceived as being weak and only marginally satisfactory.

The present invention is directed to plumbing systems utilizing a pressurized tap water supply for enhancing water delivery, without consuming additional supply water, by recirculating a portion of the previously discharged water.

The concept of recirculating discharged shower water has been known for many years primarily for use, for example, in boats, trailers, motor homes, and the like; e.g.,

| U.S. Pat. No. | Inventor |
|---|---|
| 1,065,265 | Nordmark |
| 2,308,452 | Ortyl |
| 3,606,618 | Veech |
| 3,646,618 | Johnson |
| 4,224,700 | Bloys |
| 4,413,363 | Troviano |
| 4,828,709 | Houser |
| 4,893,364 | Keeler |

These systems typically use electric motor driven pumps for recirculating discharged shower water to a shower head. A portable shower stall system utilizing a water driven pump to transport water from a base to a sink/drain is discussed in U.S. Pat. No. 4,975,992.

SUMMARY OF THE INVENTION

The present invention is directed to a water recirculation system which derives energy from an available pressurized tap water supply to filter and return previously discharged water to a tap water supplied water discharge device, such as a shower head. As an example, embodiments of the invention are able to discharge water from a shower head at a flow rate which exceeds twice the flow rate of the tap water supplied to the shower head, which may be on the order of 1.5–2.0 gallons per minute. Thus, although such a shower delivery system consumes tap water at a low flow rate consistent with water conservation objectives, it nevertheless delivers a full flow rate to a user.

Water recirculation systems in accordance with the invention are characterized by a tap water supplied shower head and a tap water powered pump for returning water discharged from the shower head for mixing with supplied tap water for delivery to the shower head.

Preferred embodiments of the invention particularly suited for new stall shower and bathtub installations, are described hereinafter. A concurrently filed U.S. patent application, Ser. No. 07/755,021, entitled "Tap Water Powered Water Recirculation System", whose disclosure is by reference incorporated herein, describes embodiments particularly suited for after-market installations, both for stall showers and bathtub configurations.

In accordance with preferred embodiments of the invention, the tap water powered pump is embodied in a jet pump assembly mounted between a tap water supply pipe and a shower head. The pump includes a tap water supply inlet, a return water suction inlet, and a water discharge outlet.

A preferred jet pump in accordance with the invention includes a driving nozzle which discharges tap water supplied to its supply inlet into an elongated mixing tube which terminates at the pump's water discharge outlet. A return water suction inlet opens into a suction chamber defined adjacent to the exit of the driving nozzle and the entrance to the mixing tube.

In accordance with a preferred jet pump embodiment, the driving nozzle and mixing tube are housed within the envelope of a pipe section which is mounted in essentially the same manner as a standard shower arm. A unidirectional valve is preferably provided between the supply inlet and the return water suction inlet to prevent backflow into the tap water supply plumbing.

In accordance with a preferred new installation embodiment, means are provided for collecting water discharged from the shower head. This water collection or pooling means is preferably incorporated in a specially designed drain assembly including a vessel intended to be mounted below the floor level of a shower stall or bathtub between a floor mounted drain opening and a waste pipe. The vessel preferably defines a slow leak path, e.g., 0.25 gallons per minute to the waste pipe, to thus enable water discharged from the shower head, e.g., at 3.0 gallons per minute, to pool in the vessel and be returned to the pump's suction inlet via a return water tube. The vessel preferably also includes overflow path means for limiting the height of the collected pool, above which water flows to the waste pipe. Suction break means are preferably incorporated in the drain assembly to prevent suctioning of material from the waste pipe.

In accordance with a further feature of a preferred new installation embodiment, a specially configured housing is provided intended to be mounted behind the wall of a shower stall or bathtub. The housing defines a tap water supply opening and a return water suction opening and is configured to readily accommodate a removable jet pump assembly (or alternatively a straight flow shower arm). In accordance with a further significant feature, the housing accommodates filter means for filtering water returned from the pool prior to its being discharged again from the shower head.

In accordance with another preferred new installation embodiment particularly suited for new shower/-bathtub installations, a specially designed multiposition drain valve is provided which in first and third positions respectively functions in a substantially normal manner to close the drain for bathtub use or open the drain for shower use. In a second position, however, it functions to close the drain to thus form a water pool within a vessel mounted below the bathtub floor level while still providing a slow leak path for draining the pool when a user finishes his shower. A return water line couples the vessel to the suction inlet of the tap water powered pump to recirculate discharged water.

DETAILED DESCRIPTION

Figures 1A, 1B:
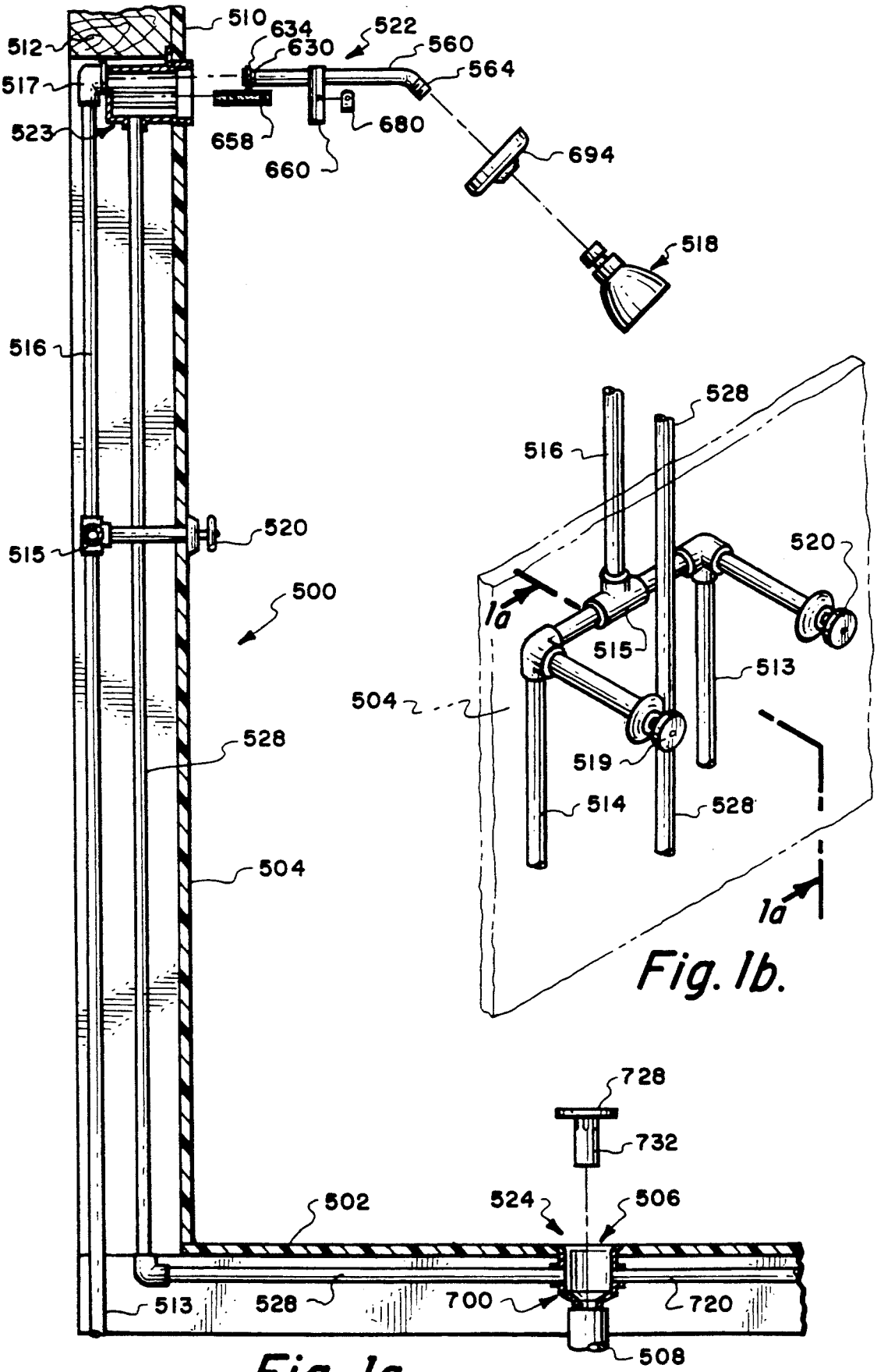
FIG. 1*a* is a sectional view of an embodiment of the present invention in a new shower stall installation.
FIG. 1*b* is an isometric view showing a conventional stall shower plumbing configuration utilized in the installation of FIG. 1*a;*
Figures 2, 3:
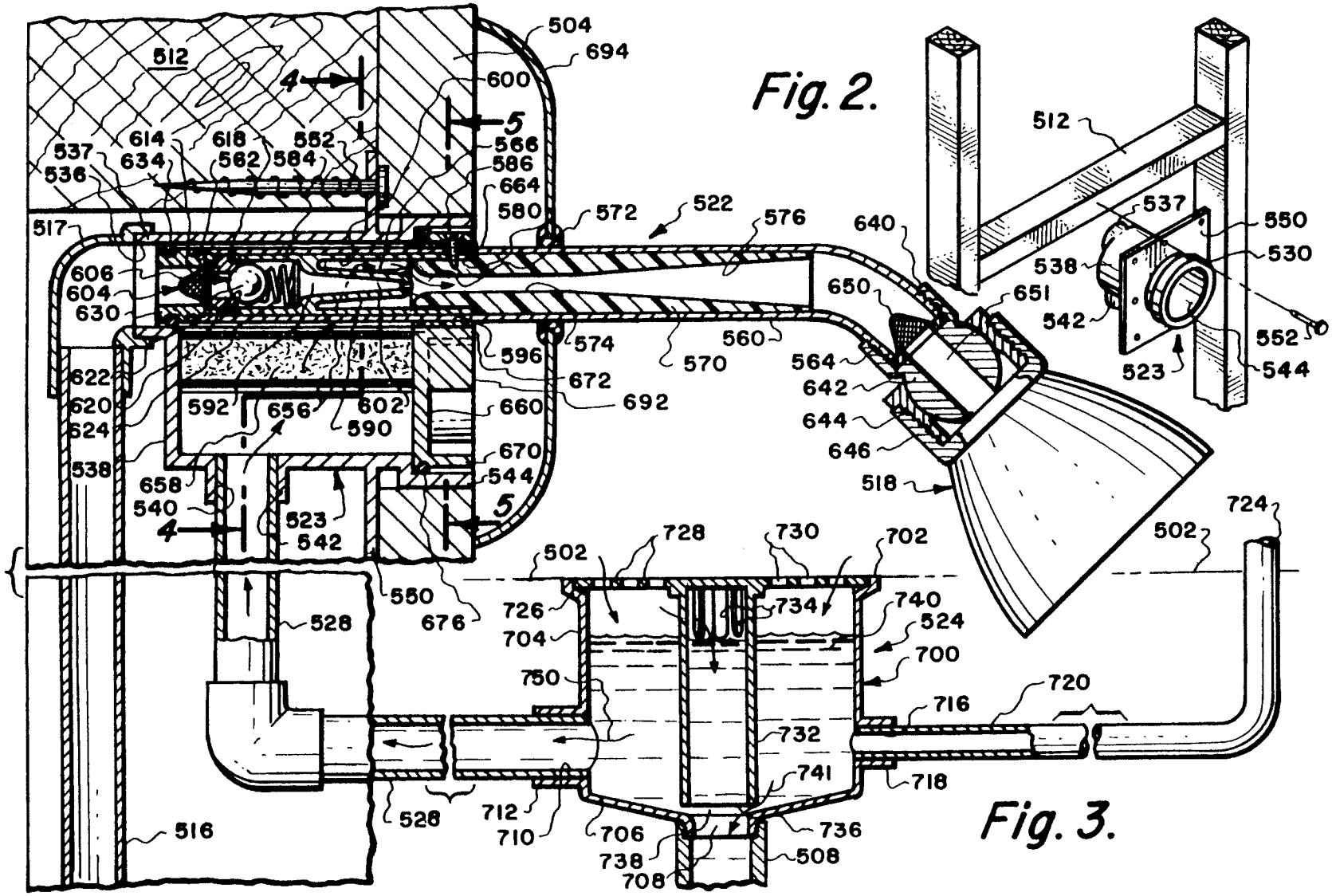
FIG. 2 is an isometric view depicting a specially configured housing intended to be mounted on the studs of a shower stall wall for accommodating the jet pump assembly of FIG. 1*a;*
FIG. 3 is a sectional view depicting a preferred jet pump assembly and drain assembly useful in the shower stall installation of FIG. 1.

Attention is initially called to FIG. 1*a* which illustrates a preferred embodiment of a tap water powered water recirculation system for use in a new shower stall installation 500. The shower stall is partially defined by a floor 502 and a wall 504. The floor 502 defines a drain opening 506 leading to a waste pipe 508. The wall 504 is generally defined by some fascia, e.g., wall board 510 secured to structurally support member such as wood studs 512 (FIG. 2). As is typical, hot and cold tap water supply pipes 513, 514 are located behind the wall 504, leading to a fitting 515 for supplying water via pipe and elbow 517 to a shower head 518. Valve handles 519,520 respectively control valves (not shown) which enable a user to establish the relative flow rates from pipes 513, 514 to fitting 515, and thus the temperature of the water delivered to elbow 517.

A preferred embodiment of the invention, as depicted in FIG. 1*a*, is primarily comprised of a specially configured jet pump assembly 522, a specially configured housing 523 for removably receiving the jet pump assembly 522, and a specially configured drain assembly 524 for pooling water discharged from the shower head 518 for recirculation to the jet pump assembly 522 via a return tube 528, preferably mounted behind wall 504.

Attention is now particularly directed to FIGS. 2–6 which depict the jet pump assembly 522 and the housing 523 in greater detail.

The housing 523 (FIGS. 2,3) basically comprises a water tight cylinder 530, preferably formed of brass or an appropriate plastic material, such as PVC or ABS. The housing 523 defines three openings; namely a supply opening 536, formed by a cylindrical nipple 537 projecting from the housing rear wall 538, a suction opening 540 defined in nipple 542, and an access opening 544 at the front of the housing cylinder 530. A mounting flange 550 is preferably formed integral with the cylinder 530 for facilitating the mounting of the housing 523 on a stud 512, as by an appropriate fastener 552. As is best shown in FIG. 3, supply opening nipple 537 mates with supply elbow 517 and suction opening nipple 542 mates with return tube 528.

Figure 6A:
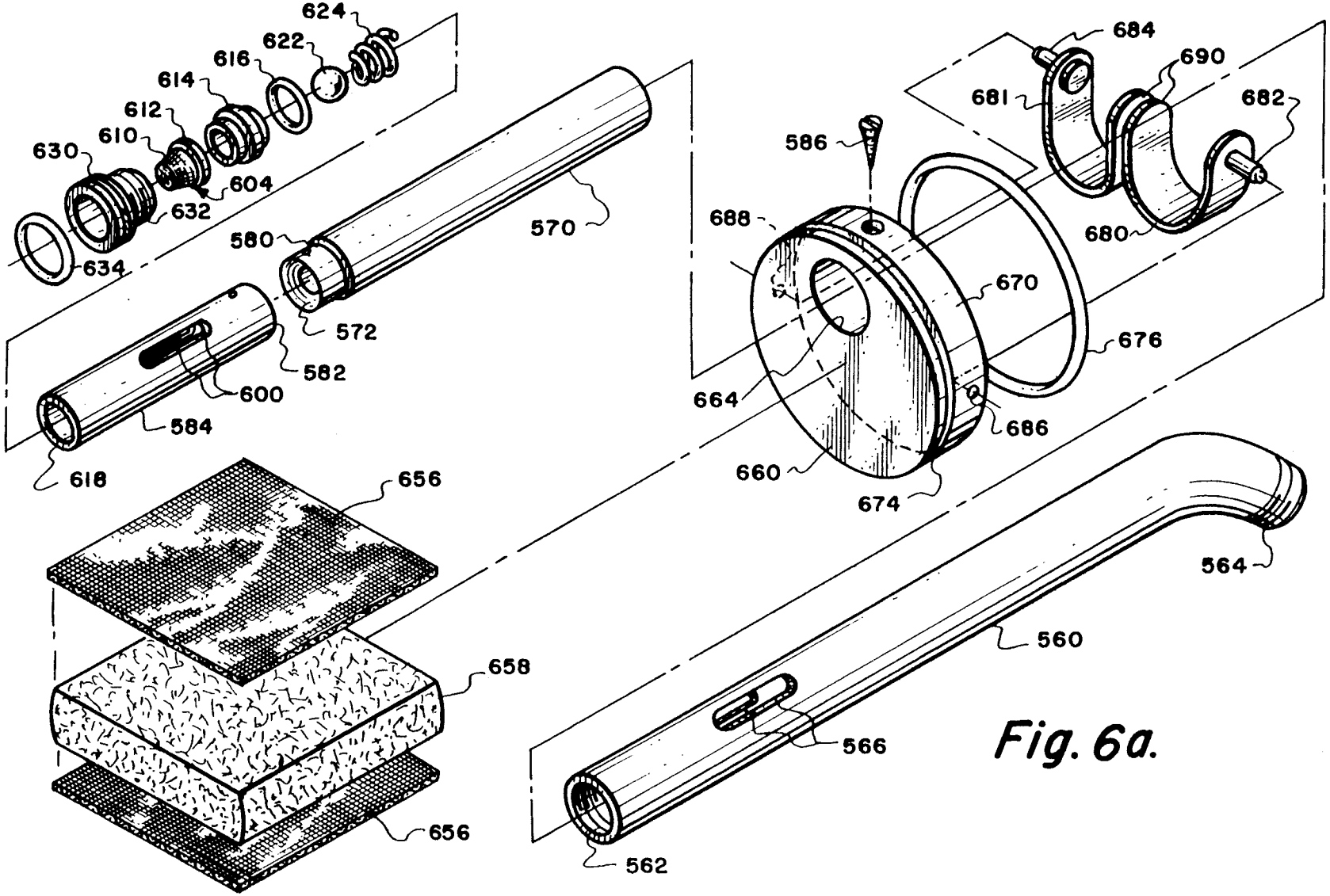
FIG. 6*a* is an exploded isometric view of the jet pump assembly of FIG. 3 configured for mounting in the housing of FIG. 2.
Figure 8B:
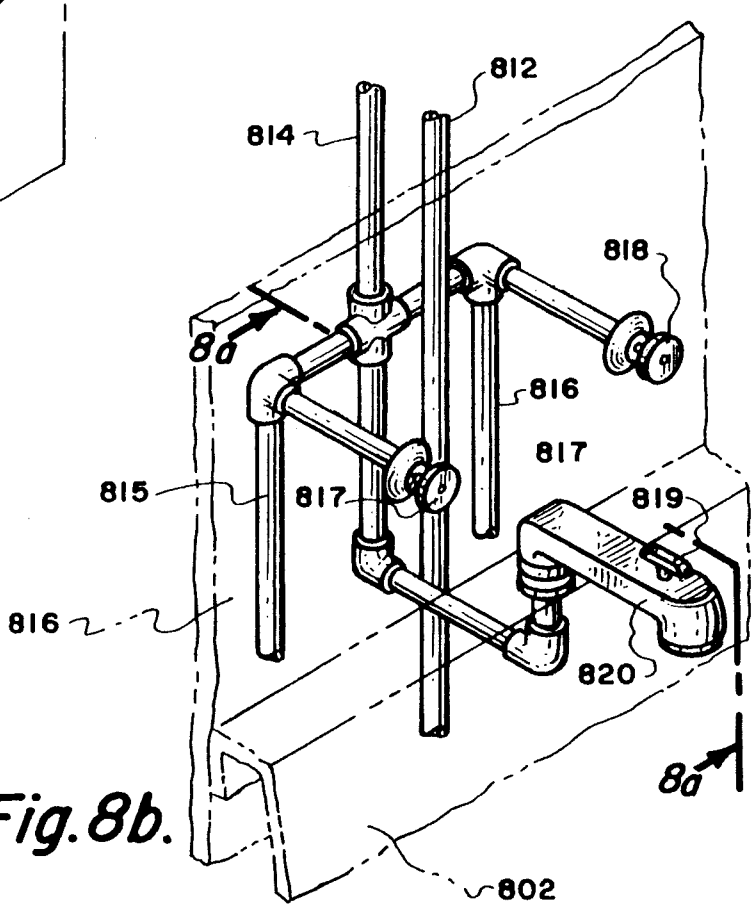
FIG. 8*b* is an isometric view showing a conventional shower/bathtub plumbing configuration utilized in the installation of FIG. 8*a;*

The tap water powered pump in accordance with the preferred embodiment, as depicted in FIGS. 3 and 6*a*, comprises jet pump assembly 522 consisting of jet pump elements mounted within a pipe arm 560. The pipe arm 560 has a first internally threaded open end 562 and a second externally threaded open end 564. Additionally, the pipe arm 560 defines intermediate openings 566.

Mounted within the pipe arm 560 is an elongate mixing tube 570 which internally defines a converging mouth section 572, an intermediate straight section 574, and a diverging exit section 576. The outer surface of the mixing tube 570 is relieved at 580 proximate to the converging mouth section 572. The forward end 582 of a nozzle member 584 is mounted concentrically around the relieved end 580 of the mixing tube 570. A fastener such as screw 586 is provided to retain both the mixing tube 570 and nozzle member 584 in position within the pipe section 560.

Internally, the nozzle member 584 includes a converging driving nozzle 590 having an entrance 592 and an exit 596. The nozzle member 584 is located so that the exit 596 is located proximate to the mouth 572 of the mixing tube 570. The nozzle member 584 defines one or more openings 600 which communicate the pipe section intermediate opening 566 with the region or chamber 602 in the vicinity of the nozzle exit 596 and mixing tube mouth 572.

In use, pressurized tap water supplied via elbow 517 to diving nozzle 590 will produce a high velocity water discharge from the exit 596 to create a suction in the chamber 602 which, as will be seen hereinafter, draws water previously discharged from the shower head 518 through the intermediate opening 566 and nozzle member opening 600 into the chamber 602.

An in-line screen 604 and unidirectional check valve 606 are preferably mounted in the pipe 560 between the elbow 517 and the entrance 592 to nozzle 590. The screen 604 is preferably comprised of screen material 610, e.g., shaped in the form of a truncated cone, mounted across a washer 612. The washer 612 mounts against the rear face of an apertured block 614. The front face of the block 614 receives an O-ring 616 for sealing the interface between the block 614 and the rear edge 618 of the nozzle member 584. The forward face of block 614 also defines a seat 620 for ball valve element 622 which is urged against the seat by a coil spring 624. Valve element 622 prevents any flow back into the tap water plumbing.

A plug 630 having a threaded forward end 632 is threaded into the rear open end 562 of pipe 560 as shown in FIG. 3 to sandwich block 614 against nozzle member 584. Plug 630 is grooved to accommodate O-ring 634 which is intended to seal against the inner surface of the wall of housing 523 around supply opening 536.

The externally threaded forward end 564 of pipe 560 is intended to mate with internally threaded collar 640, preferably integrally formed with apertured ball element 642. A swivel block 644 is mounted so as to be able to swivel on the ball 642. A shower head collar 646 is threaded onto the swivel block 644 as depicted in FIG. 3. A screen filter 650 is preferably held between the end 564 of pipe 560 and the ball 642 in line with a water inlet passageway 651 defining the water path to outlet openings (not shown) in the shower head body.

Figure 4:
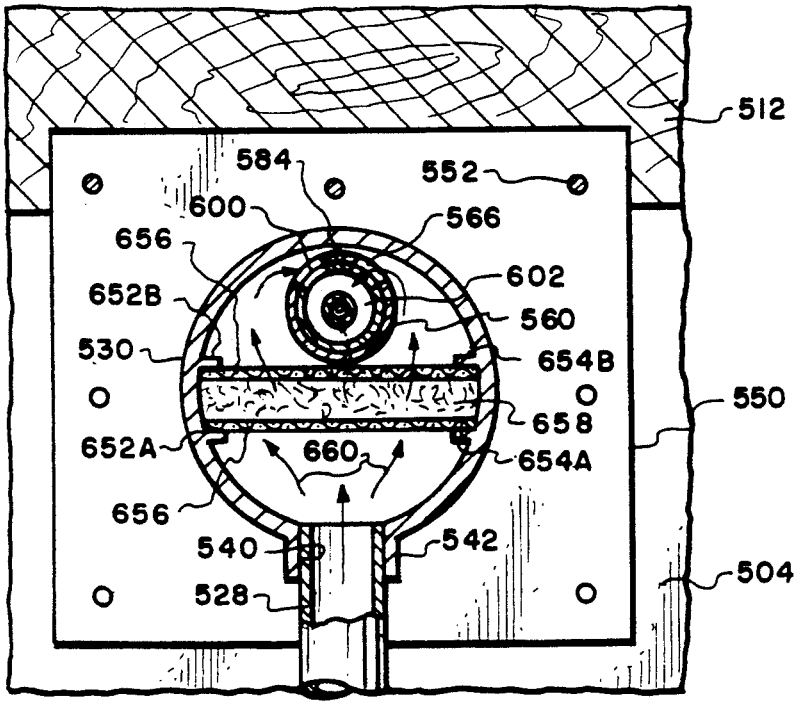
FIG. 4 is a sectional view taken substantially along the plane 4—4 of FIG. 3.

As is best shown in FIG. 4, the housing cylinder 530 carries internally projecting support elements 652A, 652B and 654 A, 654B which together define a channel for removably receiving screens 656 and filter 658. The filter 658 is formed, e.g., of small pore open cell foam. In use, water returned via tube 528, and represented by flow arrows 660, is drawn past lower screen 656 and through filter 658. Screens 656 function to remove large particles, and filter 658 functions to remove small particles, soap film, etc., from the return flow 660 prior to it passing through openings 566 and 600 into suction chamber 602 for mixing with the supplied tap water prior to being discharged through shower head 518.

A forward cover plate 660 (FIGS. 3 and 6*a*) is provided having an opening 664 through which the pipe arm 560 extends. The cover plate 660, which is preferably affixed to pipe arm 560, e.g., by gluing, is comprised of a cup shaped forward section defined by an outer cylindrical wall 670, and an inner cylindrical flange 672 around opening 664. The aforementioned screw fastener 586 is threaded into the flange 672. The outer cylindrical wall 670 has a groove 674 for accommodating an O-ring 676 intended to seal against the inner surface of the cylindrical housing wall 530 as shown in FIGS. 3 and 5.

Figure 5:
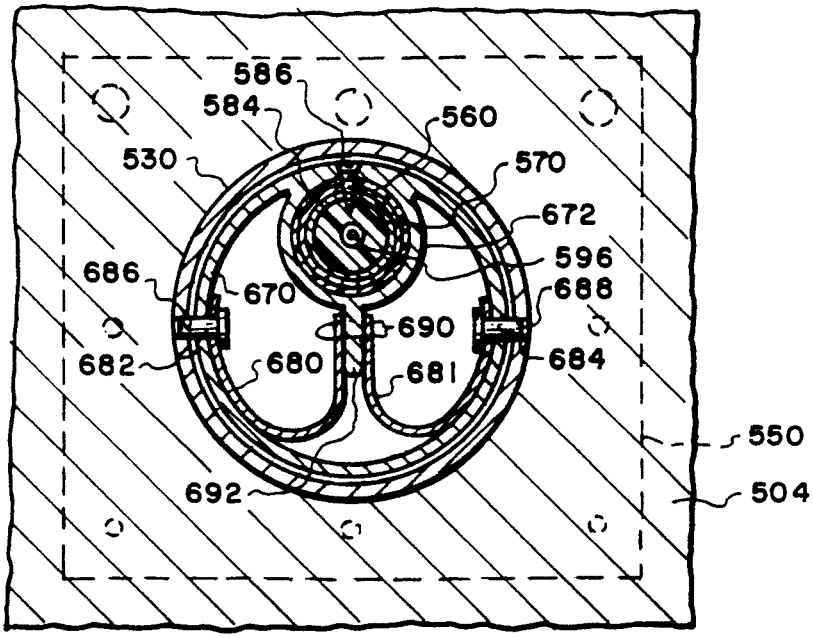
FIG. 5 is a sectional view taken substantially along the plane 5—5 of FIG. 3.
Figure 7:
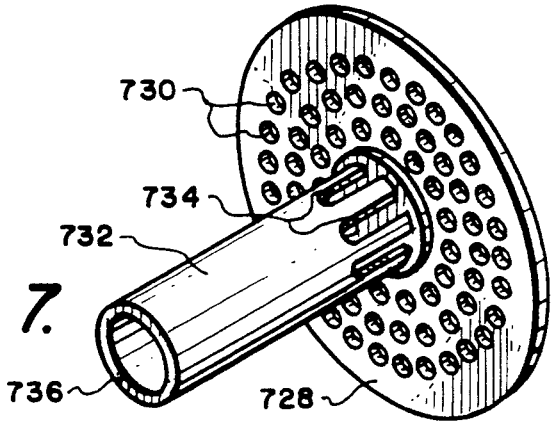
FIG. 7 is an isometric view of the floor plate element of the drain assembly of FIG. 3.

The cover plate 660 is held within the housing 523, by a pair of simple manually operable spring clips 680, 681 which respectively have oppositely projecting retaining pins 682 and 684 thereon (FIG. 5). The pins 682 and 684 are respectively receivable in holes 686 and 688 extending radially outward through the cylindrical walls of both the cover plate 660 and housing 530. The spring clips 680, 681 are essentially U-shaped having free inner ends 690 which bear against member 692, depending from cylindrical flange 672 (FIG. 5), to urge the pins 682, 684 into the holes 686, 688 for retaining the cover plate 660 within the housing 523.

In order to remove the spring clips 680, 681 without tools to enable the pipe arm 560 and screen and filter elements to be axially withdrawn from the housing 523, a user can press together the spring clips immediately below the depending member 692.

A trim plate 694 is preferably mounted on the pipe arm 560 for the purpose of covering the housing 523 for aesthetic reasons.

The aforementioned drain assembly 524 is primarily comprised of an open top vessel 700 having a top edge 702. The vessel 700 is intended for mounting beneath the floor 502 with the top edge 702 located level with the upper surface of the floor 502. The vessel 700 includes a peripheral wall 704 and a bottom wall 706 sloped toward an opening 708 which communicates with the aforementioned waste pipe 508. The vessel wall 704 additionally defines a suction outlet (or return opening) 710 within nipple 712, intended to accommodate the inlet end of return tube 528. The outlet end of return tube 528 is received in nipple 542 of the jet pump assembly 522.

The vessel wall 704 additionally defines an opening 716 in nipple 718, intended to accommodate one end of an air tube 720. The other end 724 of the air tube is open to the air at an elevation above the floor 502. The open top of the vessel 700 is preferably flared outwardly at 726 for receiving a drain plate 728. The plate 728 defines multiple apertures 730 which enable water to flow from the floor surface 502 into the interior of the vessel 700. An overflow tube 732 defining inlet openings 734 depends from the plate 728. Its lower end 736 terminates short of the upper surface of the sloped floor 706 to thereby provide a limited clearance opening 738. The clearance opening 738 is dimensioned to permit the pool of water 740 which accumulates in vessel 700 to leak, represented by flow arrow 741 to the waste pipe 508 at a rate of about 0.25 gallons per minute. Inasmuch as the shower head 518 will typically discharge water at a rate of approximately 3.0 gallons per minute, the water pool 740 will quickly accumulate after a shower is initiated. Once the height of pool 740 rises to a level above the suction outlet 710, water will be pulled from the pool, as represented by flow arrows 750, through the return pipe 528, through filter material 658, into the suction chamber 602 for entrainment by the high velocity tap water discharged from the nozzle exit 596. The water pool 740 will continue to rise to a level defined by the overflow opening 734, after which it will overflow into the overflow tube 732 and be discharged into the waste pipe 508.

The air tube 720 and suction break opening 716 are provided to prevent the suctioning of material from the waste pipe 508 into the return tube 528. By providing the suction break opening 716 and the air tube 720, if for any reason the pool 740 becomes depleted, e.g., by the drain plate apertures 730 being occluded, then the suction produced by nozzle 590 will act via return tube 528 to pull air through tube 720 from its elevated open end 724.

Figure 6B:
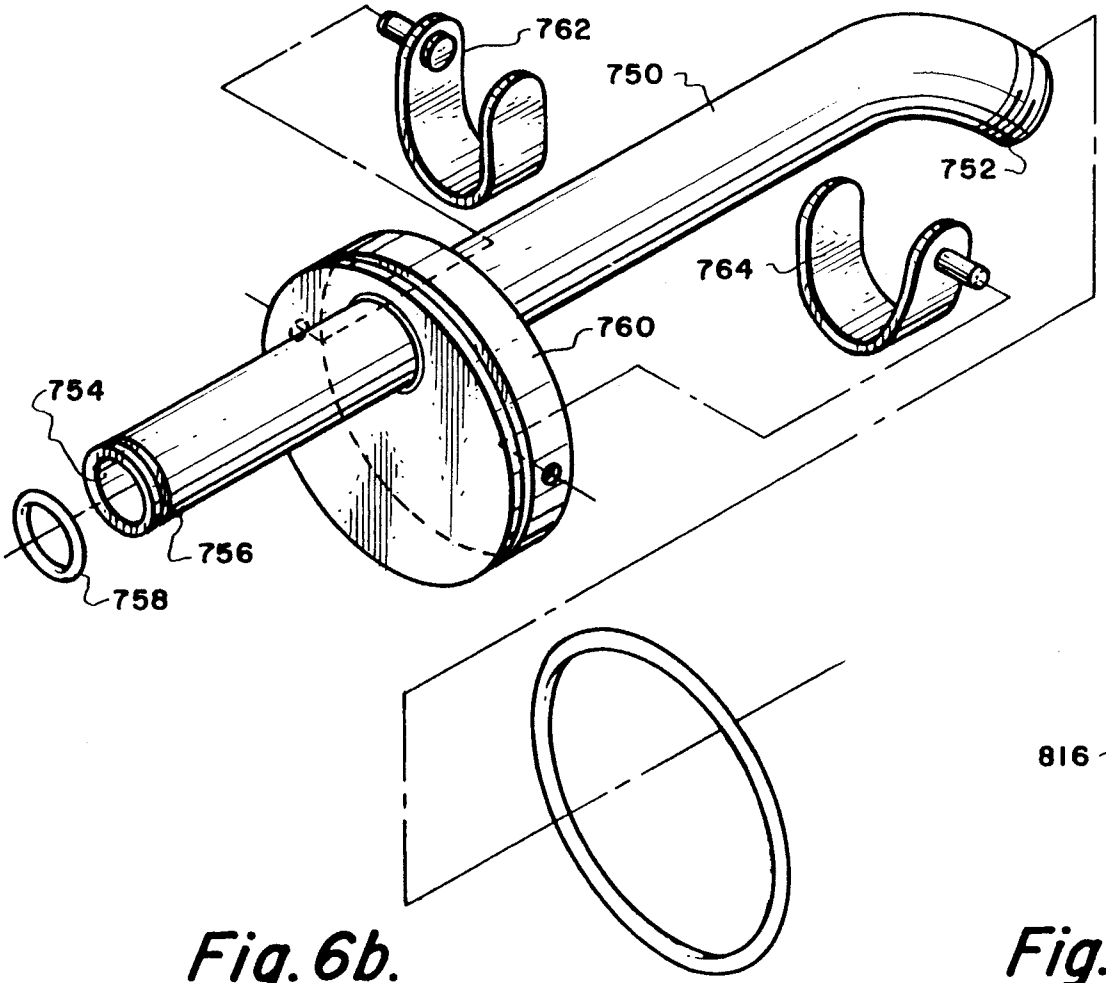
FIG. 6*b* is an exploded isometric view of a straight flow shower arm configured for mounting in the housing of FIG. 2.
Figures 8A, 10:
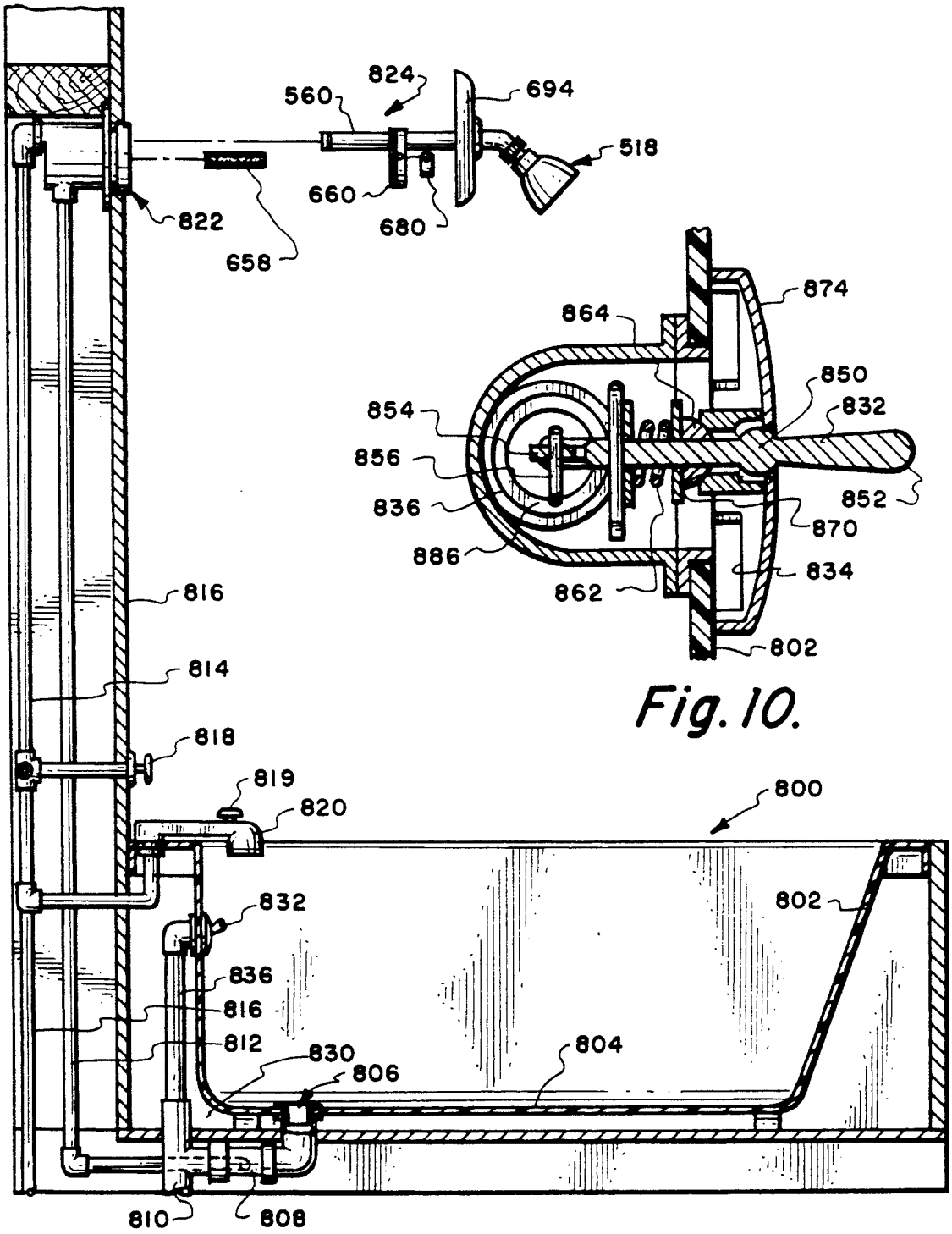
FIG. 8*a* is a sectional view of an embodiment of the present invention in a new shower/bathtub installation.
FIG. 10 is a sectional view of the drain valve taken substantially along the plane 10—10 of FIG. 9*a*.

The purpose of the present invention is to provide the capability of delivering a full flow from a shower head (e.g., 3.0 gallons per minute or more), while still conserving water by taking only about half that amount from the tap water supply. Even in geographic regions which do not frequently experience water shortages, it is contemplated that builders may elect to install the housing 523 at construction time to prepare for drought conditions. FIG. 6*b* depicts a straight flow shower arm configured to be accommodated in the housing 523, in lieu of the jet pump assembly 522, for delivering water to a shower head without a return (or recirculated) water component. The shower arm of FIG. 6*b* is comprised of a pipe arm 750 externally threaded at its forward end 752 for receiving a shower head (not shown). Its rear end 754 is provided with an annular groove 756 for accommodating O-ring 758, enabling it to be received in housing 523, adjacent the housing supply opening, in the same manner as is shown in FIG. 3. The pipe arm 750 carries a cover plate 760, identical to the aforedescribed cover plate 660, which can be removably held in the housing by spring clips 762, 764. Thus, with the housing 523 in place, a person could use the shower arm of FIG. 6*b* in a normal, nonrecirculation manner. In the event of a water shortage year, the shower arm of FIG. 6*b* could then be readily replaced by the jet pump assembly 522 of FIG. 6*a*.

Attention is now directed to FIGS. 8–11 which illustrate an embodiment of the invention installed in a shower/bathtub configuration. The bathtub 800 is defined by a peripheral wall 802 and floor 804. The floor 804 defines a drain opening 806 which is coupled to a pipe 808 which defines a vessel for pooling water entering the opening 806, as will be described in greater detail in connection with FIG. 9*a*–9*c*. The vessel 808 is coupled to a waste pipe 810 and to a return tube 812. Both the return tube 812, as well as a tap water supply pipe 814, are shown installed behind a wall 816 immediately adjacent the bathtub 800. The supply pipe 814 is fed by hot and cold water supply pipes 815, 816 via valves (not shown) controlled by valve handles 817, 818 (FIG. 8*b*). A conventional diverter valve 819 determines whether the water from pipes 815, 816 is delivered to spout 820 or to supply pipe 814. The return tube 812 and supply pipe 814 are coupled to a housing 822 and jet pump assembly 824, identical to the housing 523 and jet pump assembly 522 previously described in connection with FIGS. 1 and 3.

The embodiment of FIGS. 8–11 primarily introduces a multiposition valve assembly 830 having a valve handle 832 which can be mounted in place of a standard drain valve assembly (e.g., see U.S. Pat. Nos. 3,656,188 and 3,228,039) conventionally used in bathtubs. In conventional drain valve assemblies, a handle 832 is typically mounted on the bathtub peripheral wall 802 proximate to an overflow opening 834 which leads to an overflow pipe 836 which communicates via its open bottom with the waste pipe 810. Conventional drain valve assemblies typically accommodate two positions; namely, an open position which directly opens the bathtub drain opening 806 to the waste pipe 810, used both for draining the bathtub and while in a conventional shower mode, and a closed position which is used when it is desired to fill the bathtub. The drain assembly 830 in accordance with the present invention, depicted in FIGS. 9*a*–9*c*, includes a third position (FIG. 9*b*) in which water is pooled in the vessel 808 by restricting the leakage from the pool to approximately 0.25 gallons per minute. In other words, when the drain valve assembly 830 is in the position shown in FIG. 9*b*, it functions similarly to the drain assembly 524 of FIGS. 1 and 3.

Figures 9A, 9B, 9C, 11:
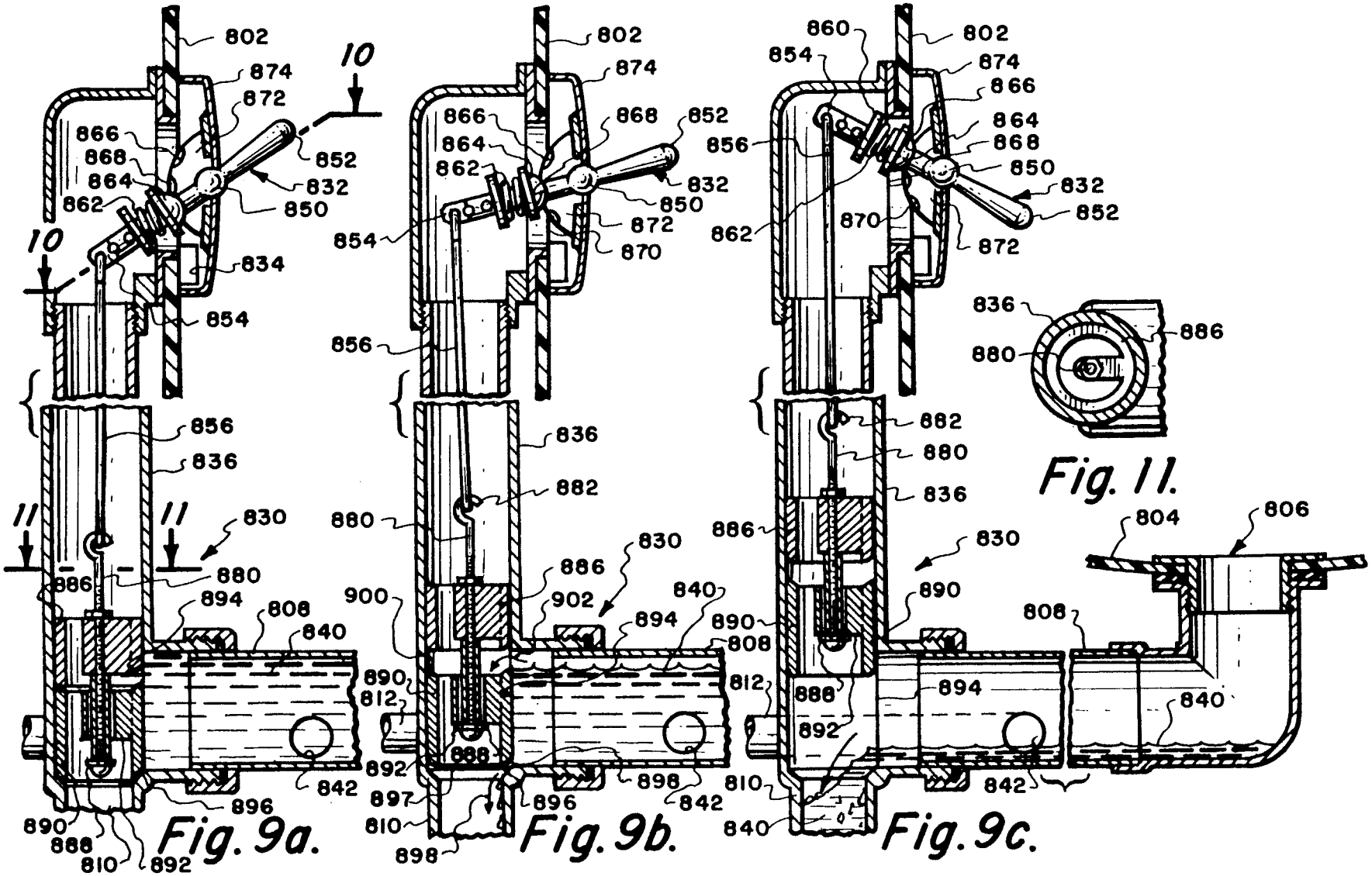
FIG. 9*a* is a sectional view of a drain valve embodiment for use in the installation of FIG. 8 showing the drain valve in a first position sealing the drain path.
FIGS. 9*b* and 9*c* respectively show the drain valve of FIG. 9*a* in a second position for using the shower head in a water circulation mode and a third position for draining the bathtub.
FIG. 11 is a sectional view taken substantially along the plane 11—11 of FIG. 9*a*.

Initially referring to FIG. 9*c*, note that the drain opening 806 is coupled to the pipe 808 which comprises a vessel for accumulating a water pool 840. A suction outlet opening 842 is formed in the pipe 808 and communicates with the return tube 812.

The drain valve assembly 830 is comprised of the aforementioned valve handle 832 which is mounted for pivotal movement about a swivel ball element 850 located intermediate the ends of handle 832. Whereas the outer end 852 of the handle 832 is available to a user, an inner end of the handle 854 is connected to a vertical rod 856. A fixed flange 860 is secured to the handle 832 proximate to its rear end 854. A coil spring 862 bears against the flange 860 and against a ball detent element 864 mounted for limited axial movement along the handle. The detent element 864 is thus spring urged forwardly and can be selectively received in any one of three recesses 866, 868 and 870 formed in block 872 located within trim plate 874 mounted on the bathtub peripheral wall 802.

The rod 856 is coupled to a second rod 880 by hook 882. The rod 880 carries an upper tubular valve element 886, but extends past the valve element 886, terminating at a lifter flange 888. The tubular valve element 886 is secured to the rod 880 so that by lifting the rod 856, the valve element 886 will be correspondingly lifted. Thus, valve element 886 can be progressively moved, within overflow pipe 836, from the position shown in FIG. 9*a* to the position shown in FIG. 9*b* and then to the position shown in FIG. 9*c*. These three positions are of course selectively defined by the handle 832 being pivoted to move the detent element 864 from recess 866 to recess 868 to recess 870.

In addition to the valve element 886, a lower tubular valve element 890 is provided for linear movement in the overflow tube 836. The valve element: 890 can be moved upwardly by engagement of the lifter flange 888 against the lower surface of internal collar 892 within the valve element 890.

In the position shown in FIG. 9*a*, with the rod 856 at its lowest position, both valve elements 886 and 890 will be at their lowest position thus completely blocking the sidewall port 894 from pipe 808 to waste pipe 810 and that upper valve element 886 is seated against the upper edge of lower valve element 890. Thus, port 894 is completely sealed. Note, in this position that the lower valve element 890 is seated on ledge 896 at the top of waste pipe 810. Note also in FIG. 9*a* that the lifter flange 888 is displaced from the valve element collar 892.

Attention is now called to FIG. 9*b* which illustrates the handle 832 in its intermediate position. Note that the valve element 886 has been lifted by the same amount that the rod 856 has been lifted. Note however that the valve element 890 has been raised by a lesser amount because it does not start moving vertically until the flange 888 moves into engagement with the valve collar 892. FIG. 9*b* shows this intermediate position in which the valve element 890 has moved off the ledge 896 providing a sufficient clearance 897 to allow a leakage flow, e.g., 0.25 gallons per minute, represented by arrow 898, from the pool 840 to the waste pipe 810. The drain valve position depicted in FIG. 9*b* is used when the system is to be operated in the recirculation shower mode in order to accumulate the pool 840. Note also that when the height of pool 840 rises above the upper edge 900 of valve element 890, pool water will overflow, as represented by arrow 902, flowing between the valve elements and through the center of valve element 890 to waste pipe 810. When the drain valve is in the position depicted in FIG. 9*b*, the jet pump assembly 824 can draw water from the pool 840 via the suction outlet 842 and return tube 812.

When it is desired to drain the bathtub or operate the system in a conventional, i.e., nonrecirculation shower mode, the drain valve handle 832 is moved to the position depicted in FIG. 9*c* in which flange 888 has fully raised valve element 890 to thus fully open pipe 808 to the waste pipe 810.

From the foregoing, it should now be appreciated that a water recirculation system has been disclosed incorporating a tap water powered pulp which enables a shower head to discharge a flow rate considerably greater than the rate at which tap water is supplied. The invention finds particular utility in new shower stall or shower/bathtub installations in which the return tube 528, pooling means 524, and jet assembly housing 523 can be mounted behind the wall or floor. For example, a user is able to experience a high shower flow rate, e.g., in excess of 3.0 gallons per minute, while taking a considerably lesser flow, e.g., approximately 1.5 gallons per minute, from the tap water supply. Although the preferred embodiments disclosed herein utilize a jet pump incorporated within a pipe arm supporting a shower head, it should be recognized that other types of tap water powered pumps could be utilized. It is also pointed out that although it is particularly convenient to locate the tap water powered pump within the shower pipe arm, as depicted in the disclosed embodiments, the pump in accordance with the invention, could be mounted anywhere between the return opening (e.g., 710) and the shower head inlet, as for example, closer to the floor.

Moreover, although preferred pooling means embodiments have been disclosed herein, it should be recognized that many alternative arrangements could be used for returning water to the shower head. For example, in a rather simple embodiment, the drain path could merely be closed, as by a stopper or existing valve, and the shower stall pan or bathtub could be used to pool water. In such an embodiment, the return opening could be formed directly in the floor, or in the wall proximate to the floor, of the shower or bathtub. It should also be understood that although the shower installations depicted herein have included only a single shower head, embodiments of the invention would of course also be useful in multiple head installations in which a single pump could return water to multiple heads or a separate pump could be provided for each head.

We claim:

1. A shower water delivery system for use in a stall or bathtub installation having a wall and floor and including tap water supply means, drain path means coupling a drain opening to a waste pipe mounted below the level of said floor, and a shower head having an inlet and an outlet mounted above said drain opening, said system comprising:

water pooling means mounted between said drain opening and said waste pipe for forming a pool of water discharged from said shower head; and recirculation means for recirculating at least a portion of the water in said pool for discharge through said shower head, said recirculation means including:

pump means having a supply inlet coupled to said tap water supply means, a discharge outlet coupled to said shower head, and a suction inlet coupled to said pool, said pump means being responsive to tap water supplied to said supply inlet for drawing water from said pool via said suction inlet for mixing with said supplied tap water prior to discharge through said shower head.

2. The system of claim 1 wherein said pooling means includes a vessel mounted beneath said floor for accommodating said pool, said drain opening being open to said vessel; and a suction outlet formed in said vessel and coupled to said pump means suction inlet.

3. The system of claim 2 further including overflow means providing a water flow path from said vessel to said waste pipe for limiting the height of said pool.

4. The system of claim 3 further including means defining a leakage path from said vessel to said waste pipe for draining said pool.

5. The system of claim 2 wherein said vessel is comprised of a vertically extending peripheral wall, an open top substantially coincident with said drain opening, and an outlet port communicating with said waste pipe; and leakage means for restricting the rate of water flow from said outlet port to said waste pipe to less than the rate of water flow discharged from said shower head; and overflow means providing a flow path from said vessel to said waste pipe for limiting the height of said pool.

6. The system of claim 1 wherein said pump means includes means for mixing said supplied tap water with said water drawn from said pool prior to discharge through said shower head.

7. The system of claim 1 including means for filtering said water drawn by said pump means.

8. The system of claim 1 wherein said pump means comprises a jet pump.

9. The system of claim 1 including pipe means coupling said supply pipe to said shower head; and wherein said pump means is housed in said pipe means.

10. The system of claim 1 wherein said tap water supply means includes hot and cold water supply pipes, a common supply pipe, and valve means coupling said hot and cold water supply pipes to said common supply pipe; and means coupling said common supply pipe to said pump means supply inlet.

11. The system of claim 10 further including a bathtub spout; and diverter valve means for selectively coupling said hot and cold water supply pipes either to said common supply pipe or said bathtub spout.

12. A shower water delivery system for use in a bathtub shower installation including a tap water supply pipe, a floor, a drain opening coupled to a waste pipe mounted below the level of said floor, and a shower head mounted above said drain opening, said system comprising:

water pooling means mounted between said drain opening and said waste pipe for forming a pool of water discharged from said shower head; and recirculation means for recirculating at least a portion of the water in said pool for discharge through said shower head;

said recirculation means including pump means having a supply inlet coupled to said supply pipe, a discharge outlet coupled to said shower head, and a suction inlet coupled to said pool;

said pump means being responsive to tap water supplied to said supply inlet for drawing water from said pool and discharging it through said shower head; and wherein said water pooling means includes valve means selectively operable in a first position to define a leakage path for allowing water flow from said pool to said waste pipe at a rate less than the rate of water flow discharged from said shower head.

13. The system claim 12 wherein said valve means is selectively operable in second and third positions for respectively defining a fully open and a fully closed path between said drain opening and said waste pipe.

14. The system of claim 12 wherein said valve means in said first position further defines an overflow path for limiting the height of said pool.

15. A shower water delivery system for use in a stall or bathtub shower installation having a wall and floor and including tap water supply means, and a shower head having an inlet and outlet mounted above said floor, said system comprising:

a water return opening formed proximate to said floor; and recirculation means coupling said return opening to said shower head inlet for returning at least a portion of the water discharged from said shower head outlet to said shower head inlet, said recirculation means including:

a pump having a supply inlet, a discharge outlet, and a suction inlet;

means supplying tap water from said supply means to said pump supply inlet for producing a suction at said suction inlet;

means coupling said discharge outlet to said shower head inlet; and return tube means at least partially mounted behind said wall for coupling said pump suction inlet to said return opening.

16. The system of claim 15 wherein said recirculation means further includes:

vessel means mounted beneath said floor for forming a pool of water discharged from said shower head outlet; and wherein said return opening communicates with said vessel means for enabling water from said pool to be drawn through said return tube means.

17. The system of claim 15 further including a drain opening formed proximate to said floor coupled to a waste pipe mounted beneath said floor; and wherein said vessel means includes overflow means defining a flow path from said pool to said waste pipe for limiting the height of said pool.

18. The system of claim 15 wherein said pump comprises a jet pump.

19. The system of claim 18 including a pipe arm coupling said tap water supply means to said shower head inlet; and wherein said pump is housed in said pipe arm.

20. A method of delivering water from a tap water source to a shower head in a stall or bathtub installation having a wall and floor so as to discharge a greater flow rate from the shower head than is taken from the tap water source, said method comprising:

supplying tap water from said source to a pump to produce a suction for drawing water discharged from said shower head to a suction inlet of said pump; and delivering a water flow to said shower head comprised of said tap water supplied to said pump and said water drawn to said suction inlet; and wherein said water drawn to said suction inlet and/or delivered to said shower head is passed through a return tube mounted behind said wall.

21. The method of claim 20 including the further step of collecting a pool of water discharged from said shower head below the level of said floor; and wherein said step of drawing water comprises communicating said suction inlet with said pool.

* * * * *